US005507350A

United States Patent [19]

Primlani

[11] Patent Number: 5,507,350

[45] Date of Patent: Apr. 16, 1996

[54] FIRE EXTINGUISHING WITH DRY ICE

[76] Inventor: Indru J. Primlani, 2616 NE. 19th St., Renton, Wash. 98056

[21] Appl. No.: 282,799

[22] Filed: Jul. 29, 1994

[51] Int. Cl.[6] ..... A62C 3/02

[52] U.S. Cl. ..... 169/47; 169/36; 169/54

[58] Field of Search ..... 169/36, 43, 45, 169/46, 47, 52, 53, 54, 57, 70, 91

[56] References Cited

U.S. PATENT DOCUMENTS

| | | | |
|---|---|---|---|
| 1,928,909 | 10/1933 | Reasor | 169/36 |
| 2,174,606 | 10/1939 | Tansill | 169/46 |
| 2,858,895 | 11/1958 | Connell | 169/45 |
| 3,070,172 | 12/1962 | Carter, Jr. | 169/46 |
| 3,833,064 | 9/1974 | Ranney, Jr. | 169/36 X |
| 4,986,363 | 1/1991 | Nahmias | 169/46 |

FOREIGN PATENT DOCUMENTS

| | | | |
|---|---|---|---|
| 2315290 | 1/1977 | France | 169/47 |
| 2603492 | 3/1988 | France | 169/47 |
| 2624750 | 6/1989 | France | 169/52 |
| 2626478 | 8/1989 | France | 169/36 |
| 4109989 | 10/1992 | Germany | 169/36 |
| 776616 | 11/1980 | U.S.S.R. | 169/47 |
| 1399471 | 5/1988 | U.S.S.R. | 169/54 |
| 1405848 | 6/1988 | U.S.S.R. | 169/45 |

*Primary Examiner*—Andrew C. Pike

[57] ABSTRACT

A remote fire fighting method provides for remote and early response delivery of solid carbon dioxide in capsules by means of standard artillery guns to cool the fire and displace needed oxygen from the fire, useful for fighting fires difficult to approach such as forest fires as well as fires in developed areas, such as urban multistory buildings. Projectiles of encapsulated solid carbon dioxide are produced and strategically stored refrigerated until a fire occurrence at which time they are launched as a projectile from standard artillery guns in a pattern that surrounds the windward side adjacent and outside the fire followed by a pattern of launched projectiles about one-third of the way into the fire from the leeward side such that carbon dioxide gas from said first and second sets envelopes at least a portion of the fire area and migrates through the fire, chilling it and excluding oxygen for combustion therein to arrest progress of and extinguishing the fire.

1 Claim, 3 Drawing Sheets

FIRE EXTINGUISHING WITH DRY ICE

BACKGROUND OF THE INVENTION

1. Field of the Invention

The present invention relates to fire fighting equipment and methods and more particularly to extinguishing fires by employing capsules of solid carbon dioxide launched into a fire to cool the fire and deprive the fire of needed oxygen.

2. Description of the Prior Art

The conditions necessary for the existence of fire are the presence of a combustible substance, a temperature high enough to cause or support combustion (called the kindling temperature), and the presence of enough oxygen (usually provided by the air) to enable combustion to continue. Therefore, fire fighting consists of removing one or more of these. It is known in the art to have water supplied to a fire to cool the fire below combustion temperatures. It is also known to involve chemicals other than water, especially useful for fires involving flammable liquids, particularly when water may be dangerous.

A variety of chemicals may be added to water to improve its ability to extinguish fires. For example, wetting agents added to water can reduce its surface tension. This makes the water more penetrating and facilitates the formation of small drops necessary for rapid heat absorption. Also, by adding foam-producing chemicals and liquids to water, a fire-blanketing foam is produced which is used to extinguish fires in combustible liquids, such as oil, petroleum, and tar, and for fighting fires at airports, refineries, and petroleum distribution facilities chemical additive can also expand the volume of foam, perhaps by 1000 times. This high-expansion foam-water solution is useful in fighting fires in basements and other difficult-to-reach areas because the fire can be smothered quickly with relatively little water damage. It is also known to use chemicals, such as carbon dioxide, to displace needed oxygen from a fire. Carbon dioxide is used particularly for extinguishing fires because it does not burn and does not support ordinary combustion.

The atmosphere contains carbon dioxide in variable amounts, usually 3 to 4 parts per 10,000 (and has been increasing by 0.4 percent a year). Carbon Dioxide is a colorless, odorless, and slightly acid-tasting gas about 1.5 times as dense as air. It readily available in large quantities, being produced in a variety of ways, such as by combustion, or oxidation, of materials containing carbon, such as coal, wood, oil, or foods; by fermentation of sugars; and by decomposition of carbonates under the influence of heat or acids. Commercially, carbon dioxide is recovered from furnace or kiln gases; from fermentation processes; from reaction of carbonates with acids; and from reaction of steam with natural gas, a step in the commercial production of ammonia. The carbon dioxide is purified by dissolving it in a concentrated solution of alkali carbonate or ethanolamine and then heating the solution with steam. The gas is evolved and compressed into steel cylinders.

It is also known to have various equipments to deliver water or other chemicals to the fire. With the development of the internal-combustion engine early in the 20th Century, Fire Department pumpers became motorized. Because of problems in adapting geared rotary gasoline engines to pumps, the first gasoline-powered fire engines had two motors, one to drive the pump and the other to propel the vehicle. The pumps were originally of the piston or reciprocating type, but these were gradually replaced by rotary pumps and finally by centrifugal pumps, used by most modern pumpers. At the same time, the pumper acquired its main characteristics: a powerful pump that can supply water in a large range of volumes and pressures; several thousand feet of fire hose, with short lengths of large-diameter hose for attachment to hydrants; and a water tank for the initial attack on a fire while fire fighters connect the pump to hydrants, and for areas where no water supply is available. In rural areas, pumpers carry suction hose to draw water from rivers and ponds.

Various nozzles are capable of projecting solid, heavy streams of water, curtains of spray, or fog. Fire trucks carry a selection of nozzles, which are used according to the amount of heat that must be absorbed. Nozzles can apply water in the form of streams, spray, or fog at rates of flow between 57 liters (15 gal) to more than 380 liters (more than 100 gal) per minute. Straight streams of water have greater reach and penetration, but fog absorbs heat more quickly because the water droplets present a greater surface area and distribute the water more widely. Fog nozzles may be used to disperse vapors from flammable liquids, although foam is generally used to extinguish fires in flammable liquids.

Auxiliary vehicles are equipped with specialized equipment for effecting rescue, ventilating buildings, and salvage. Aerial ladders that typically extend to 30.5 m (100 ft) are carried on "hook and ladder" vehicles that also hold various kinds of tools and equipment, including heavy-duty jacks and air bags, extrication tools, oxyacetylene torches, self-contained breathing apparatus, and resuscitators. Other more basic equipment includes axes, shovels, picks, battering rams, power saws, hooks, and wrenches. Elevating platform trucks can raise fire fighters and equipment, including the water delivery system, as high as 30.5 m (100 ft). Rescue trucks carry a wide assortment of specialized emergency equipment, including the type that might be used in building collapses and cave-ins. Field communications units carry sophisticated electronic equipment for use in managing fire and emergency operations. Salvage trucks carry implements for reducing water damage, including large waterproof covers, dewatering devices, and tools for shutting off water flow from sprinkler heads.

Various fire fighting techniques are also known in the art. The basic tactics of fighting a fire can be divided into the following categories: rescue operations, protection of buildings exposed to the fire, confinement of the fire, extinguishing the fire, and salvage operations. The officer in charge, usually designated as the fireground commander, surveys the area and evaluates the relative importance of these categories. The commander also estimates what additional assistance or apparatus may be needed.

Once the fireground commander has appraised the situation, fire fighters and equipment are deployed. Pumper, ladder, and other truck companies, as well as rescue squads, are assigned to different areas of the fire, usually in accordances with the number and types of hose streams the fireground commander considers necessary to control the fire and prevent its spread.

In accordance with standard procedure for first alarms, fire companies go immediately to their assigned locations without waiting for specific orders. Special plans cover contingencies such as a fire covering a large area, a large building, or a particularly hazardous location. Usually on a first alarm one of the pumpers attacks the fire as quickly as possible, using preconnected hose lines supplied by the water tank in the truck, while larger hose lines are being attached to the hydrants. Members of the ladder and rescue companies force their way into the building, search for victims, ventilate the structure (break windows or cut holes in the roof to allow smoke and heat to escape), and perform salvage operations. Ventilating the structure helps to advance the hose lines with greater safety and ease, and also serves to safeguard persons who may still be trapped in the building.

It is clear that even with existing equipment and techniques, a quick response from a distance of several miles or even several hundred yards is not available, and fire fighting in closer contact with the fire remains extremely hazardous. Temperatures within a burning building may exceed 815° C. (1500° F.). Brightly burning fires principally generate heat, but smoldering fires also produce combustible gases that need only additional oxygen to burn with explosive force. The hazards to which fire fighters and occupants of a burning building are exposed include the breathing of superheated air, toxic smoke and gases, and oxygen-deficient air, as well as burns, injuries from jumping or falling, broken glass, falling objects, or collapsing structures. Handling a hose is difficult even before the line is charged with water under pressure. Nozzle reaction forces can amount to several hundred pounds, requiring the efforts of several people to direct a stream of water.

Methods of fighting forest fires are necessarily different than fighting areas in developed areas, where access and water supply are generally less of a problem. Forest fires, often called wildland fires, are spread by the transfer of heat, in this case to grass, brush, shrubs, and trees.

Fire-fighting crews are trained and organized to handle fires covering large areas. They establish incident command posts, commissaries, and supply depots. Two-way radios are used to control operations, and airplanes are employed to drop supplies as well as chemicals. Helicopters serve as command posts and transport fire fighters and their equipment to areas that cannot be reached quickly on the ground. Some severe wildfires have required more than 10,000 fire fighters to be engaged at the same time.

Because it is frequently difficult to extinguish a forest fire by attacking it directly, the principal effort of forest fire fighters is often directed toward controlling its spread by creating a gap, or firebreak, across which fire cannot move. Firebreaks are made, and the fire crews attempt to stop the fire by several methods: trenching, direct attack with hose streams, aerial bombing, spraying of fire-retarding chemicals, and controlled back-burning. As much as possible, advantage is taken of streams, open areas, and other natural obstacles when establishing a firebreak. Wide firebreaks may be dug with plows and bulldozers. The sides of the firebreaks are soaked with water or chemicals to slow the combustion process. Some parts of the fire may be allowed to burn themselves out. Fire-fighting crews must be alert to prevent outbreaks of fire on the unburned side of the firebreaks.

It is clear that fire fighting, both in wilderness conditions and in developed areas, still lacks a capability of an immediate response safe to the fire fighter because of an inability to immediately deliver fire retarding chemicals to the fire.

SUMMARY OF THE INVENTION

The principal object of the invention is to enhance the state of the art for fighting forest fires and other fires that are particularly difficult to approach. The fire extinguishing method of the present invention contemplates remote delivery of solid carbon dioxide in capsules by means of standard artillery guns to cool the fire and displace needed oxygen from the fire. This technique is also useful for fighting forest fires, as well as fires in developed areas, such as urban multistory buildings.

Artillery rockets and missiles can cover battlefields out to extended distances with conventional and nuclear fire. Recent advances in on-board computers and self-locating capabilities enable modern cannons and rocket launchers to use so-called shoot-and-scoot tactics: individual cannons and launchers now move autonomously around the battlefield, stopping to shoot, and then quickly moving to a new firing position. Artillery cannon and launchers can deliver what are called "smart" munitions. These are projectiles that can locate and home-in on targets using sophisticated sensors and seekers.

DETAILED DESCRIPTION OF THE PREFERRED EMBODIMENT

Referring to the figures, the fire fighting method of this invention discloses an effective way of fighting a fire at its inception or fully developed and preventing a fire from getting larger. In a forest, every forest ranger station is equipped with dry ice artillery specially stored in refrigerated containers which is used as a very quick response in the first incidence of a small fire. With computer controlled projectile technology the dry ice projectile is directed right into the center of a local fire as it occurs. This type of fast response may alleviate considerable activity which could follow later if the fire was not contained immediately.

Figure 1:
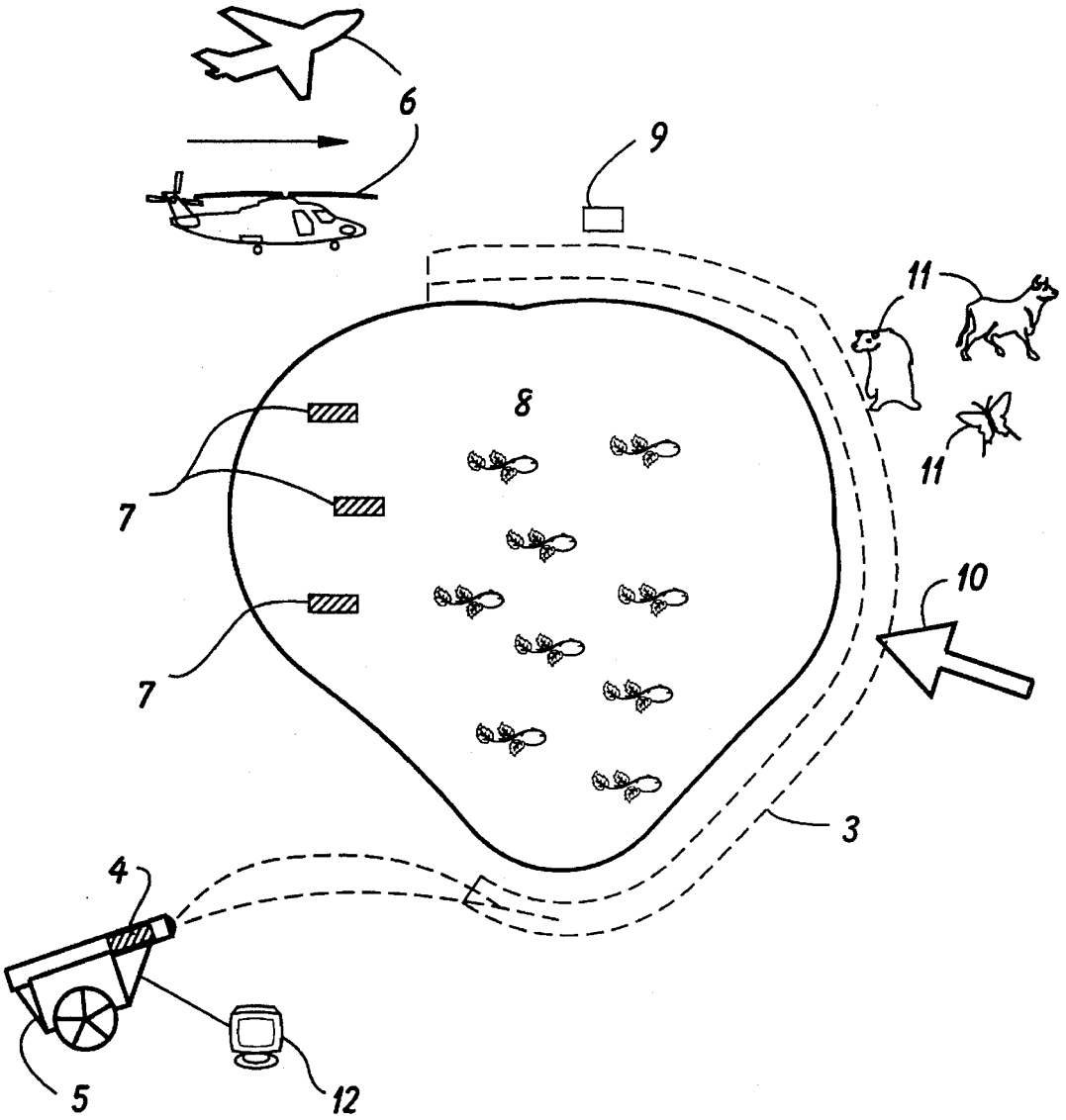
FIG. 1 is a top view showing fighting a forest fire in progress.
Figure 2:
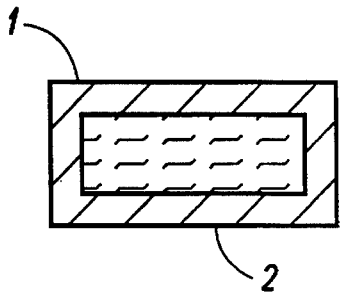
FIG. 2 shows an encapsulated solid carbon dioxide projectile.
Figure 3:
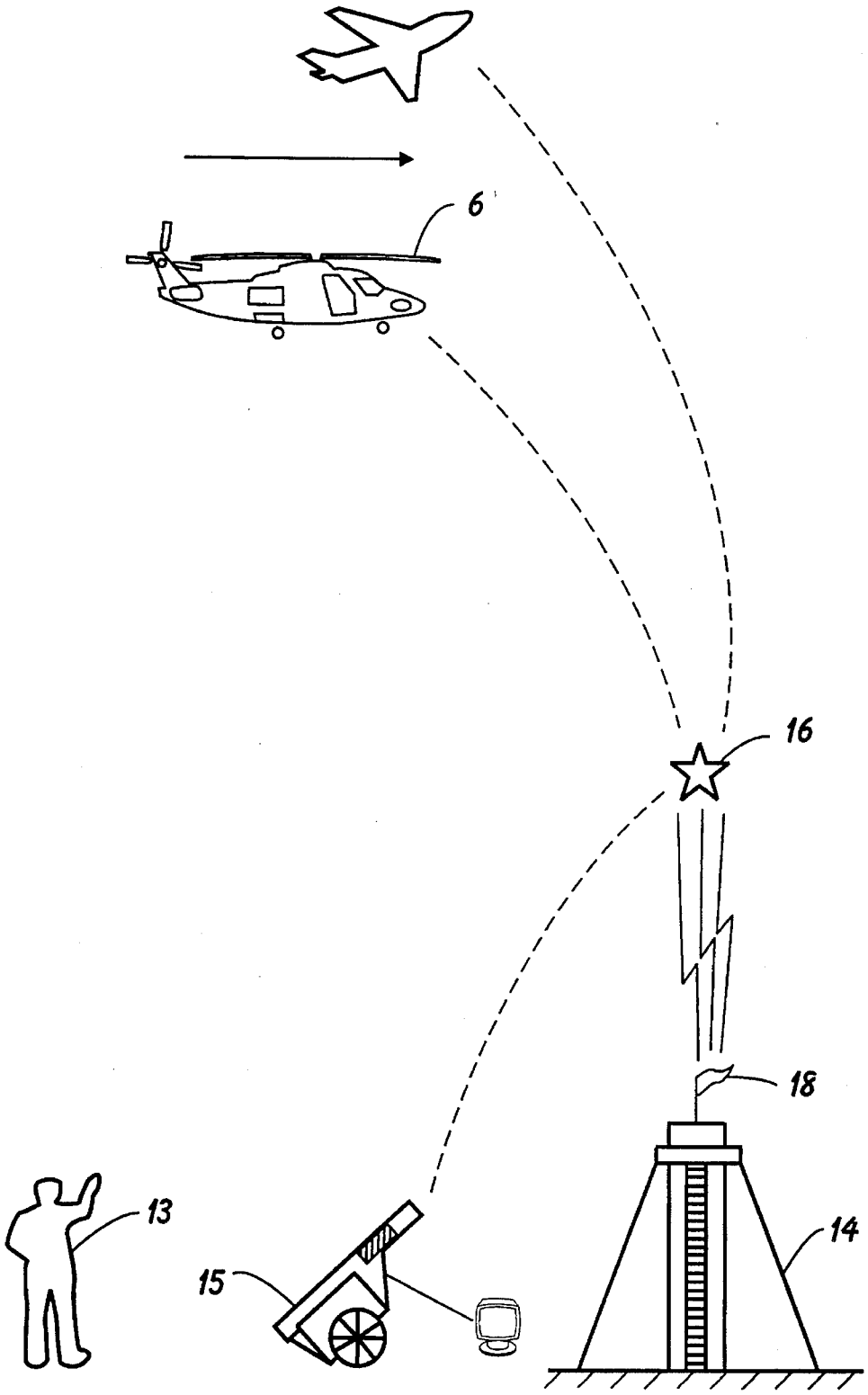
FIG. 3 shows early detection and response to a forest fire at its inception.
Figure 4:
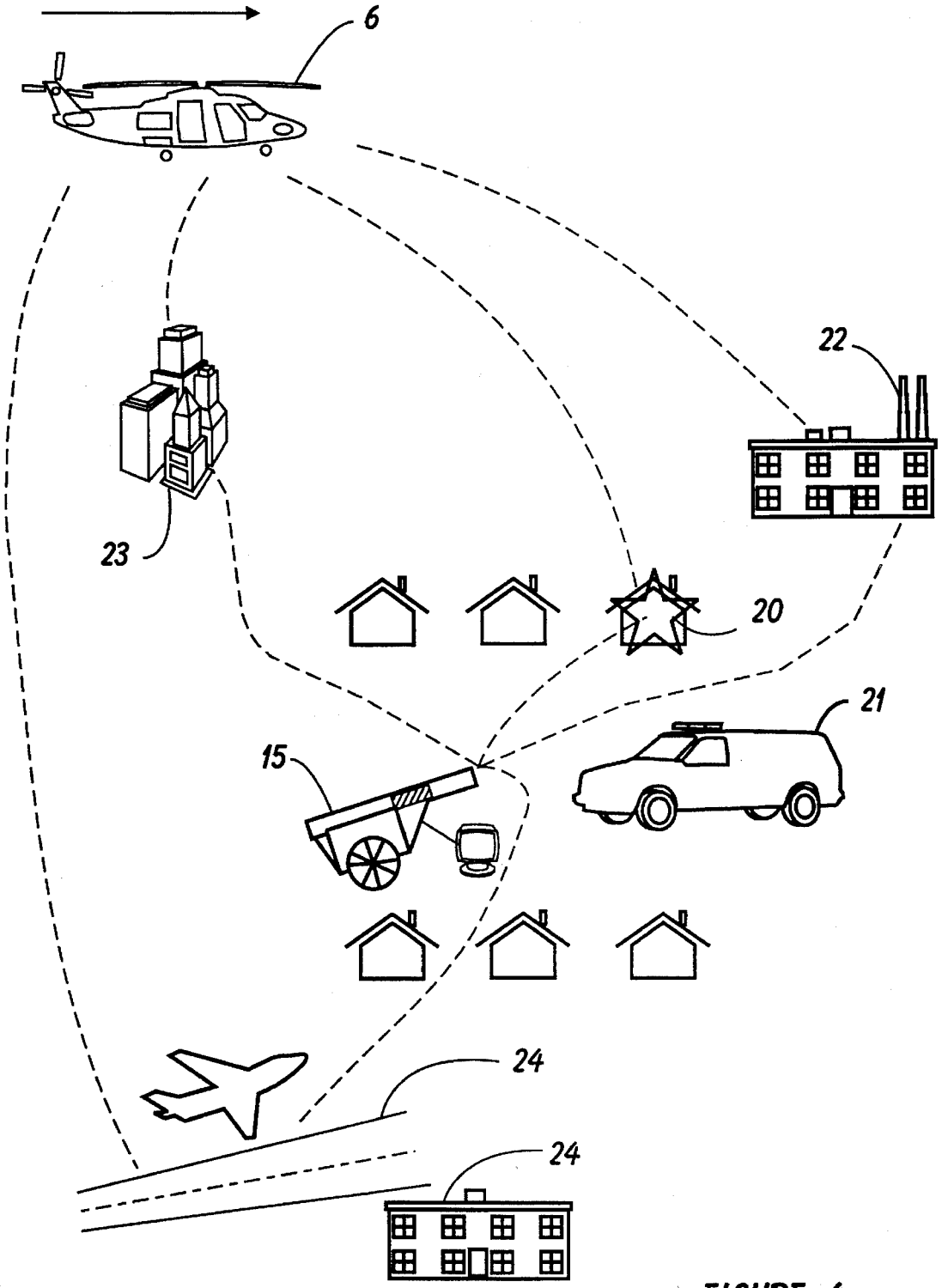
FIG. 4 shows fighting an urban area fire.

As shown in FIG. 4, this method is also used for buildings where proper control of the projectile could place the carbon dioxide blocks 4 in strategic locations in high rise buildings 23, large warehouses 22, and other areas such as airports 24 where fires are large in magnitude and difficult to fight at close range. It is also possible to use smaller projectiles of solid carbon dioxide for local fire fighting, such as even a garage or small residence 20. Fire trucks 21 are modified to carry a certain amount of dry ice, which is used effectively for fighting as standard policy.

This invention calls for a system that will utilize dry ice or frozen carbon dioxide which will sublimate directly into a gas with a refrigeration or quenching effect. The carbon dioxide is produced from available sources and compressed, liquefied, and solidified to be turned into solid blocks or bricks 2 ranging in size from a few pounds to several thousand pounds. Each block is then encapsulated with insulation to form a projectile 1 which is easily ignitable and disintegratable upon impact to release said carbon dioxide gas. These dry ice blocks are then properly stored in cryogenic containers.

Surveillance areas 17 are established and monitored. Upon detection of a fire occurrence 16, including by computer monitoring equipment 12, which may comprise infrared and other sensors 18 to detect flame designed for maximum range, or human observation 13 such as from a remote Ranger observation station 14, immediate response is initiated, such as from an artillery station 15 with capability of "immediate" response to a new fire. Artillery projectiles' firing and landing positions may be monitored and coordinated for accurate deployment using satellite communication position sensors.

During the incidence of forest fires or other major building fires, the blocks of dry ice are hurtled into the fire by means of artillery 5 or other type of prime movers such as aircraft 6. The state of the art artillery shells can also be launched from several miles away for immediate and safe response.

For instance, in the case of forest fires the approach would be to surround the existing flame windward perimeter 3 with carbon dioxide projectiles outside the fire area which would help to contain the fire on the windward side and to permit said carbon dioxide gas released from these projectiles to migrate into the fire area from the windward side. A second set of projectiles would be fired into the flames, perhaps in a pattern 7 one-third of the way into the fire area 8 from the leeward side, to release carbon dioxide gas from these projectiles directly into the fire area so that migrating $CO_2$ gas within the fire would exclude oxygen for combustion and chill the surroundings to reduce the temperature in the localized zone below ignition point of the combustible materials. Thus, the migrating carbon dioxide gas from both sets of projectiles envelope at least a portion of the fire area 8 and chills it and excludes oxygen for combustion therein to arrest progress of the fire in the direction 10 of the wind.

There will be a relatively low temperature zone on the windward side and fire fighters would be required to wear air or oxygen masks to get close to the fire zone but it would be easier for them to fight the remainder of the fire which has been contained. Presence of heavy carbon dioxide under pressure will prevent the normal suction which is created by a massive fire where surrounding air and oxygen are inducted into the fire zone. Utilization of gas pressure between the fire zone and the surrounding area will prohibit new oxygen from entering the flame and smother existing oxygen or displace the existing oxygen so that combustion in the entire localized area will be greatly reduced. Rapid control can prevent the fire from spreading and becoming larger and also require less auxiliary fire fighting which occurs as a result of a lack of control of the fire.

Having described the invention, what is claimed is:

1. A method for controlling a fire burning, in a direction of a wind, a fire area having a windward side and a leeward side and a length therebetween, said method comprising, in sequence:

producing dry ice projectiles including solidifying carbon dioxide gas into blocks and encapsulating each said block with insulation which is easily ignitable and disintegratable upon impact to release said carbon dioxide gas;

storing said dry ice projectiles;

detecting occurrence of the fire and location of the fire area;

firing a first set of said dry ice projectiles into an area adjacent to the windward side and outside of the fire area to release said carbon dioxide gas from said first set to contain the fire at the windward side and to permit said carbon dioxide gas released from said first set to migrate into the fire area from the windward side; and firing a second set of said dry ice projectiles into the fire area at about one-third of the length into the fire area from the leeward side to release said carbon dioxide gas from said second set into the fire area to migrate through the fire area;

whereby the migrating carbon dioxide gas from said first and second sets envelopes at least a portion of the fire area and chills it and excludes oxygen for combustion therein to arrest progress of the fire in the direction of the wind.

* * * * *